US007465191B1

(12) United States Patent
Ho

(10) Patent No.: US 7,465,191 B1
(45) Date of Patent: Dec. 16, 2008

(54) COAXIAL CONNECTOR

(75) Inventor: Hsin-Tsung Ho, Taipei Hsien (TW)

(73) Assignee: Cheng Uei Precision Industry Co., Ltd., Taipei Hsien (TW)

( * ) Notice: Subject to any disclaimer, the term of this patent is extended or adjusted under 35 U.S.C. 154(b) by 0 days.

(21) Appl. No.: 12/107,692

(22) Filed: Apr. 22, 2008

(51) Int. Cl.
*H01R 9/05* (2006.01)

(52) U.S. Cl. ..... 439/582; 439/394; 439/944

(58) Field of Classification Search ..... 439/63, 439/394, 582, 585, 944
See application file for complete search history.

(56) References Cited

U.S. PATENT DOCUMENTS 5,482,475 A * 1/1996 Kawaguchi ..... 439/394
6,508,668 B1 * 1/2003 Yamane ..... 439/582
6,790,082 B2 * 9/2004 Obayashi ..... 439/582
7,204,715 B2 * 4/2007 Kukita ..... 439/582
7,351,067 B2 * 4/2008 Chen et al. ..... 439/63
2006/0128233 A1 * 6/2006 Matsuura et al. ..... 439/845

* cited by examiner

*Primary Examiner*—James Harvey
(74) *Attorney, Agent, or Firm*—WPAT, P.C.; Anthony King

(57) ABSTRACT

A coaxial connector adapted to be assembled to a coaxial cable includes a conductor shell, a dielectric housing and a connection terminal. The conductor shell has a sleeve portion. The dielectric housing has a base portion received in the sleeve portion of the conductor shell. A terminal groove is defined in the base portion. The connection terminal received in the terminal groove has a connection portion and a contact portion adapted for connecting a mating extending downward from the connection portion. A locking arm is bent upward and extending along the extending direction of the connection portion from an end thereof, a free end of the locking arm protrudes toward the connection portion to form a fixing tooth for griping an inner conductor of the coaxial cable arranged between the connection portion and the locking arm.

6 Claims, 5 Drawing Sheets

COAXIAL CONNECTOR

BACKGROUND OF THE INVENTION

1. Field of the Invention

The present invention relates to a connector, and particularly to a coaxial connector adapted to be assembled to a coaxial cable.

2. The Related Art

Coaxial connectors are often used for connecting a coaxial cable with an electronic device for transmitting radio-frequency (RF) signals. For example, such a conventional coaxial connector is disclosed in U.S. Pat. No. 6,508,668. With reference to FIG. 9, the coaxial connector includes a dielectric housing 2' holding a central terminal 1' within an outer conductor shell 3'. The central terminal 1' has a flat portion 11'. An inner conductor 51' of a coaxial cable 5' is soldered to the flat portion 11'. The dielectric housing 2' is substantially cylindrical and defines a passageway 20' therein for receiving the central terminal 1' and an erect cover portion 21' adapted for covering the central terminal 1'. The conductor shell 3' includes a sleeve portion 30' for receiving the dielectric housing 2' and an erect planar portion 31' juxtaposed to the cover portion 21'. The planar portion 31' of the conductor shell 3' and the cover portion 21' of the dielectric housing 2' are simultaneously bent at right angle to make the central terminal 1' and the inner conductor 51' of the coaxial cable 5' be held in the dielectric housing 2'.

However, in assembly, the inner conductor 51' of the coaxial cable 5' is connected to the flat portion 11' of the connection terminal 1' by means of manual soldering, so that residues such as tin dregs are produced during the soldering process, which affects electrical characteristics of the coaxial connector. Moreover, the manual soldering is not only time-consuming but also labor-intensive and so the production output of the coaxial connector is limited.

SUMMARY OF THE INVENTION

An object of the present invention is to provide a coaxial connector of a simplified and further accurate connection of a coaxial cable. The coaxial connector adapted to be assembled to a coaxial cable includes a conductor shell, a dielectric housing and a connection terminal. The conductor shell has a sleeve portion and an outer cover portion extending from an end of the sleeve portion. The dielectric housing has a base portion received in the sleeve portion of the conductor shell and an inner cover portion. A terminal groove is defined in the base portion. The connection terminal received in the terminal groove has a connection portion and a pair of contact portions adapted for connecting a mating extending downward from the connection portion. A locking arm is bent upward and extending along the extending direction of the connection portion from an end of the connection portion, a free end of the locking arm protrudes toward the connection portion to form a fixing tooth for griping an inner conductor of the coaxial cable arranged between the connection portion and the locking arm. The outer cover portion is bent to make the inner cover portion be bent to press the locking arm of the connection terminal.

As described above, the outer cover portion of the conductor shell exerts pressure on the locking arm of the connection terminal via the inner cover portion of the dielectric housing, and then the locking arm drives the fixing tooth to compact the inner conductor of the coaxial cable tightly, which enables the electrical connection between the coaxial cable and the coaxial connector reliable. Since the manual soldering process is not necessary on establishing the electrical connection of the inner conductor of the coaxial cable and the connection terminal of the coaxial connector, the connection process is simplified.

BRIEF DESCRIPTION OF THE DRAWINGS

The present invention will be apparent to those skilled in the art by reading the following description of a preferred embodiment thereof, with reference to the attached drawings, in which.

DETAILED DESCRIPTION OF THE PREFERRED EMBODIMENT

Figure 1:
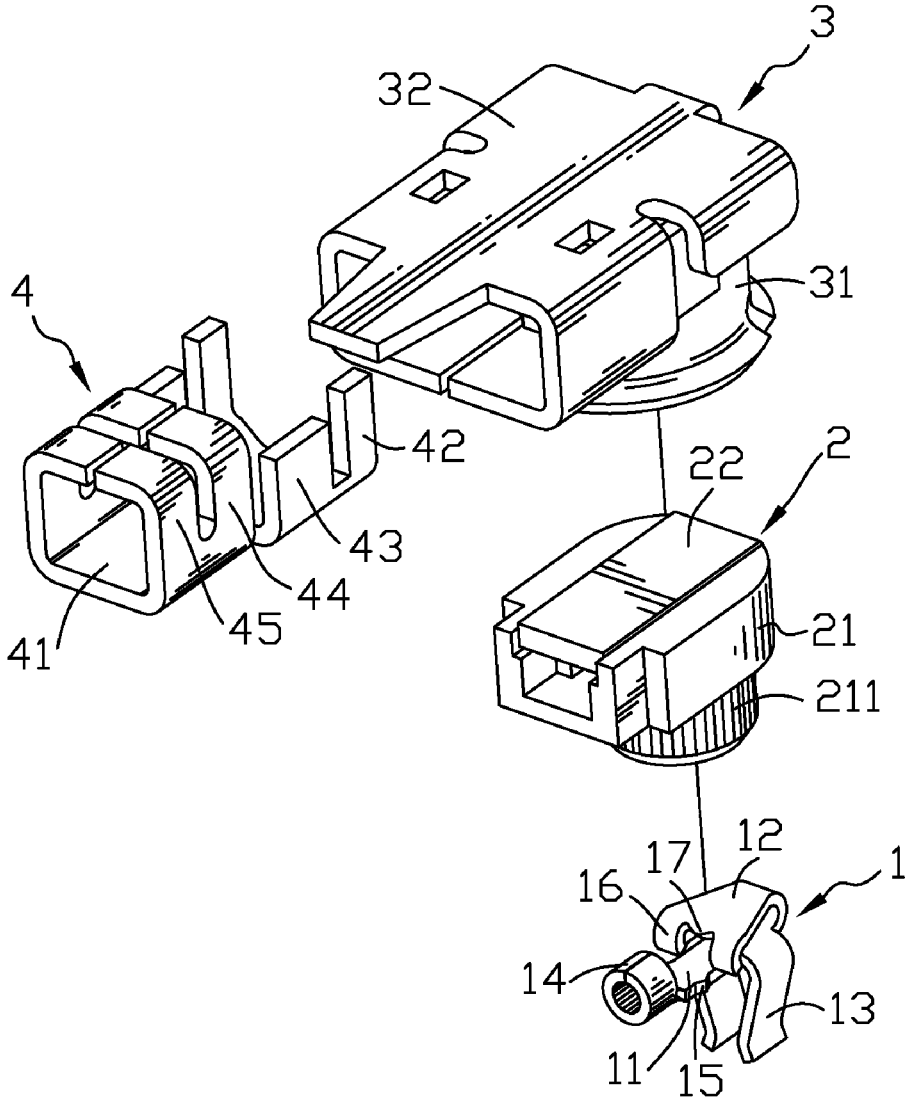
FIG. 1 is an exploded view of a coaxial connector according to the present invention.
Figure 2:
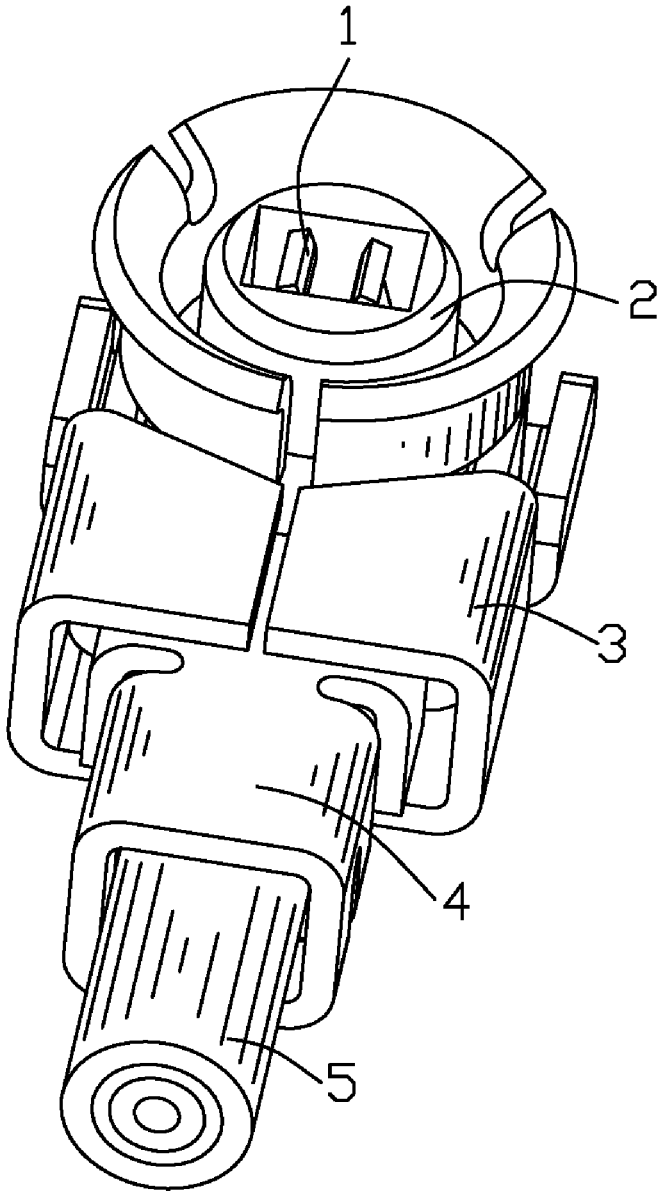
FIG. 2 is a perspective view of the coaxial connector assembled to a coaxial cable.
Figure 7:
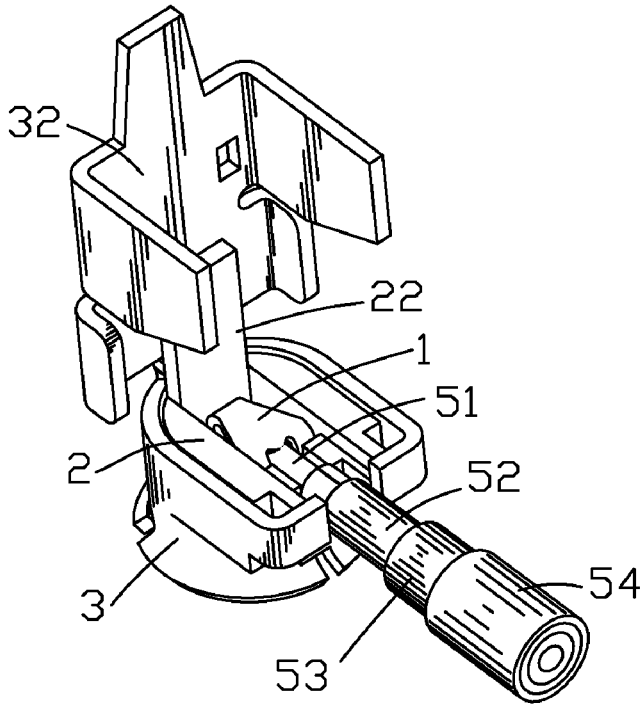
FIG. 7 is a perspective view showing a state of the coaxial connector prior to the complete assembly.

With reference to FIGS. 1, 2 and 7, a coaxial connector in accordance with the present invention is assembled to a coaxial cable 5 which includes an inner conductor 51, a conductive braiding layer 53, an inner insulator 52 separating the inner conductor 51 and the conductive braiding layer 53, and an outer insulator 54 surrounding the conductive braiding layer 53. The coaxial connector includes a connection terminal 1, a dielectric housing 2, a conductor shell 3 and a retainer 4.

Figure 3:
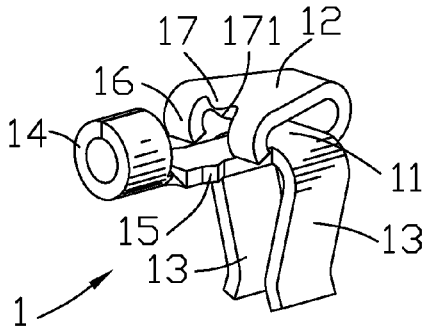
FIG. 3 is a perspective view of a connection terminal of the coaxial connector.

Referring to FIGS. 1 and 3, the connection terminal 1 has a connection portion 11. A rear end of the connection portion 11 is bent upward and then extends forward to form a locking arm 12 which is substantially parallel to the connection portion 11. A free end of the locking arm 12 protrudes toward the connection portion 11 to form two clutches 16 apart from each other and a fixing tooth 17 between the two clutches 16. The fixing tooth 17 has a pointed tip 171. A pair of contact portions 13 extends downward from opposite lateral sides of the connection portion 11 and projects toward each other for griping a mating of a complementary connector (not shown). A pair of retaining portions 15 in triangle shape extends outward from the opposite lateral sides of the connection portion 11. Two sides of the front of the connection portion 11 extend sideward and then roll up to form a cylindrical sleeve 14. The diameter of the sleeve 14 is slightly smaller than the diameter of the inner conductor 51 of the coaxial cable 5.

Figure 4:
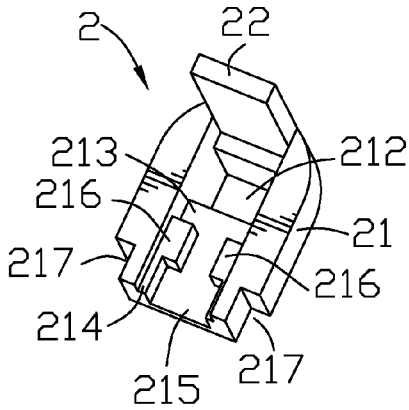
FIG. 4 is a perspective view of a dielectric housing of the coaxial connector prior to being assembled.

Referring to FIGS. 1 and 4, the dielectric housing 2 includes a base portion 21 and an inner cover portion 22 extending upward from the rear of the base portion 20. The base portion 21 has a substantially cylindrical tubular portion 211 which has a central cavity 212 passing therethrough. The base portion 21 further has a receiving groove 213 communicating with the central cavity 212, a sleeve groove 215 arranged in front of the receiving groove 213, and a cover groove 214 opened above the receiving groove 213 and the sleeve groove 215. Two indentations 217 is disposed at two sides of the base portion 21, two blocks 216 is formed at the two sides of the base portion 21 in front of the receiving groove 213. The central cavity 212, the receiving groove 213, and the sleeve groove 215 constitute a terminal groove.

Figure 5:
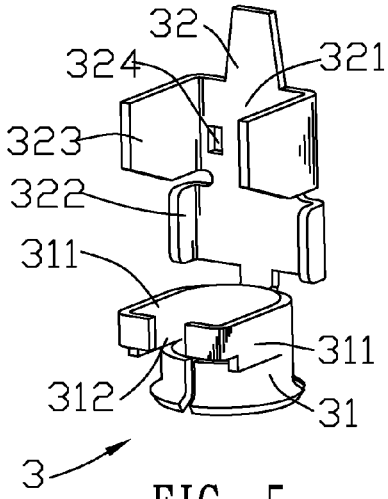
FIG. 5 is a perspective view of a conductor shell of the coaxial connector prior to being assembled.

With reference to FIGS. 1 and 5, the conductor shell 3 includes a substantially cylindrical sleeve portion 31 and an outer cover portion 32 extending upward from the sleeve portion 31. When the outer cover portion 32 is not bent, it is substantially perpendicular to the sleeve portion 31.

Two arms 311 extend forward from two sides of the sleeve portion 31 and then bend toward each other. A gap 312 is formed between opposite tips of the two arms 311. The outer cover portion 32 has a flat cover portion 321 extending upward from the rear of the sleeve portion 31. Two opposite lateral sides of the flat cover portion 321 defines a pair of tabs 322 and a pair of holding portions 323 in turn from bottom to top. A pair of narrow slots 324 is abreast opened on the flat cover portion 321.

Figure 6:
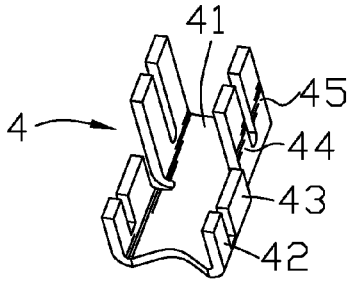
FIG. 6 is a perspective view of a retainer of the coaxial connector prior to being assembled.

Referring to FIGS. 1 and 6, the retainer 4 has a basic board 41. A pair of first surrounding portions 42, a pair of second surrounding portions 43, a pair of third surrounding portions 44 and a pair of fourth surrounding portions 45 are formed on two opposite lateral sides of the basic board 41 in turn. The length of the first surrounding portions 42 is slightly longer than that of the second surrounding portions 43 and shorter than that of the third and fourth surrounding portions 44, 45 which have the same length.

Figure 8:
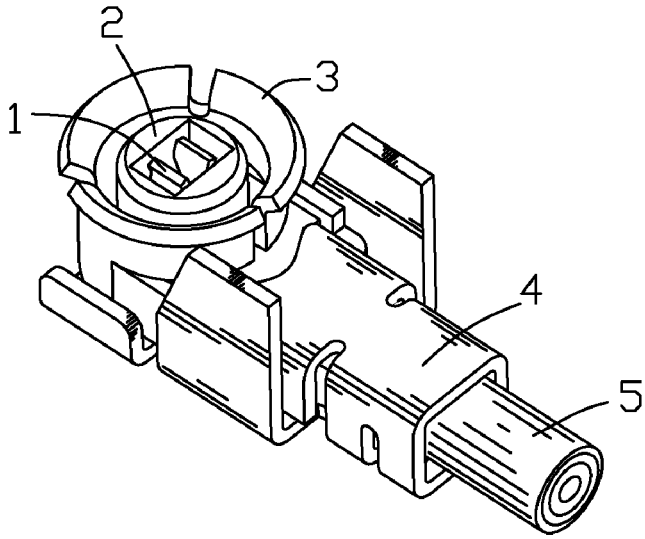
FIG. 8 is a perspective view showing another state of the coaxial connector prior to the complete assembly.
Figure 9:
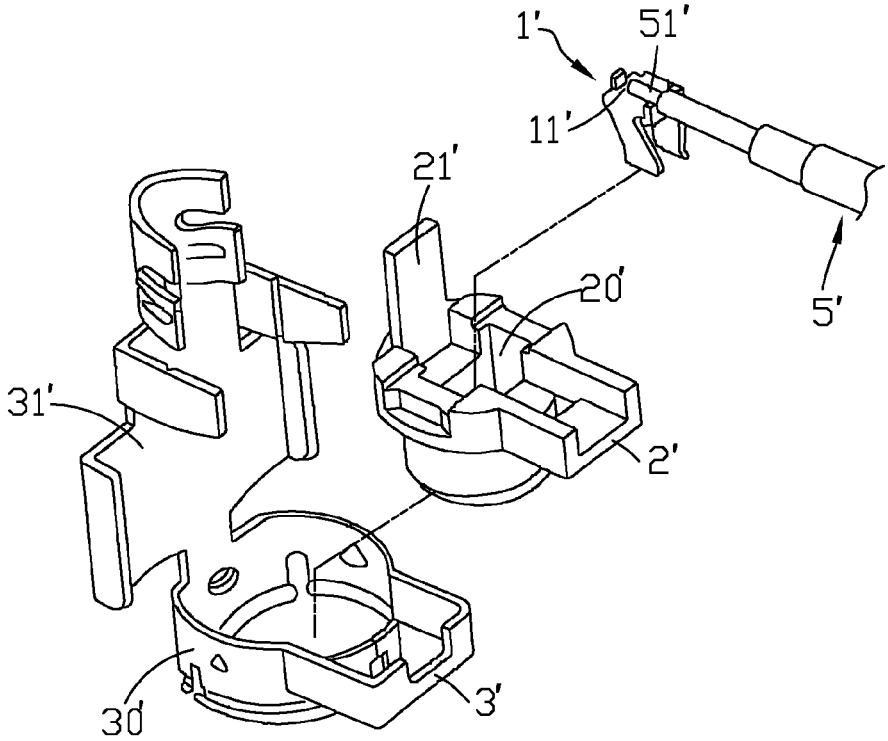
FIG. 9 (Prior Art)
FIG. 9 is an exploded view of a conventional coaxial connector assembled with a coaxial cable.

With reference to FIGS. 2, 7 and 8, the coaxial connector of the present invention is assembled as follows.

(1) First, a length of the outer insulator 54 of the coaxial cable 5 is peeled to expose the conductive braiding layer 53, the inner insulator 52, and the inner conductor 51 in turn. Then the locking arm 12 of the connection terminal 1 is lifted to be away from the connection portion 11. The inner conductor 51 is inserted into the space between the connection portion 11 and the locking arm 12 through the sleeve 14 until the front of the inner insulator 52 resists the sleeve 14. And then the locking arm 12 is released, the inner conductor 51 is stuffed into the connection terminal 1.

(2) Next, the connection terminal 1 with the coaxial cable 5 is then inserted into the base portion 21 of the dielectric housing 2. More specifically, the connection portion 11 and the locking arm 12 are received in the receiving groove 213, the mating wings 13 are inserted into the central cavity 212, the sleeve 14 is fixed in the sleeve groove 215, and the retaining portions 15 pierce into the blocks 216 for fixing the connection terminal 1 in the dielectric housing 2 firmly.

(3) Thereafter, the base portion 21 of the dielectric housing 2 assembled with the connection terminal 1 is inserted into the sleeve portion 31 of the conductor shell 3, and the inner cover portion 22 juxtaposes to the outer cover portion 32. The inner insulator 52 fills the gap 312 and is held between the two arms 311.

(4) Next, the outer cover portion 32 and the inner cover portion 22 are bent toward the sleeve portion 31 and the base portion 21 respectively to cover the connection terminal 1 inside the dielectric housing 2. After being fully bent, the inner cover portion 22 is received in the cover groove 214. At the same time, the inner conductor 51 is compacted by the locking arm 12 and specially the fixing tooth 17, the pointed tip 171 pierces into the inner connector 51 for griping the coaxial cable 5 more tightly.

(5) At last, the retainer 4 is fastened to the conductor shell 3. The first surrounding portions 42 of the retainer 4 are inserted into the slots 324 of the outer cover portion 32 of the conductor shell 3 through the indentation 217 of the dielectric housing 2 for assuring the position of the retainer 4 in the conductor shell 3. The tips of the second surrounding portion 43 resists to the flat cover portion 321. The third surrounding portions 44 and the fourth surrounding portions 45 are bent to wrap the conductive braiding layer 53 and the outer insulator 54 respectively for holding the coaxial cable 5 more tightly. Then the holding portions 323 are bent to encircle the retainer 4.

As described above, according to the present invention, the outer cover portion 32 of the conductor shell 3 exerts pressure on the locking arm 12 of the connection terminal 1 via the inner cover portion 22 of the dielectric housing 2, and then the locking arm 12 drives the fixing tooth 17 to compact the inner conductor 51 of the coaxial cable 5 tightly and the pointed tip 171 to pierce into the inner connector 51, which enables the electrical connection between the coaxial cable 5 and the coaxial connector more reliable. So the way to connect the inner conductor 51 of the coaxial connector 5 to the connection terminal 1 of the coaxial connector according to the present invention can be instead of the way of the manual soldering in prior art. Therefore, the assembly efficiency of connecting the coaxial cable 5 to the coaxial connector is enhanced and at the same time the residues are avoided producing in the assembly process, which ensures the electrical characteristics of the coaxial connector.

An embodiment of the present invention has been discussed in detail. However, this embodiment is merely a specific example for clarifying the technical contents of the present invention and the present invention is not to be construed in a restricted sense as limited to this specific example. Such modifications and variations that may be apparent to those skilled in the art are intended to be included within the scope of this invention as defined by the accompanying claims.

What is claimed is:

1. A coaxial connector adapted to be assembled to a coaxial cable, comprising:

a conductor shell having a sleeve portion;

a dielectric housing having a base portion received in the sleeve portion of the conductor shell, a terminal groove being defined in the base portion; and a connection terminal received in the terminal groove, the connection terminal having a connection portion, a contact portion extending from the connection portion and a locking arm bent upward and extending along an extending direction of the connection portion from an end of the connection portion, a free end of the locking arm protruding toward the connection portion to form a fixing tooth.

2. The coaxial connector as claimed in claim 1, wherein the conductor shell has an outer cover portion extending from an end of the sleeve portion, the dielectric housing has an inner cover portion, and the outer cover portion is bent to make the inner cover portion be bent to press against the locking arm of the connection terminal.

3. The coaxial connector as claimed in claim 1, wherein the fixing tooth has a pointed tip.

4. The coaxial connector as claimed in claim 1, wherein the connection portion of the connection terminal defines two retaining portions extending outward from opposite sides thereof, the base portion of the dielectric housing defines two blocks in the base portion, the two retaining portions respectively pierce into the blocks for fixing the connection terminal in the dielectric housing firmly.

5. The coaxial connector as claimed in claim 1, wherein the free end of the locking arm protrudes towards the connection portion to form two clutches, the fixing tooth is disposed between the two clutches.

6. The coaxial connector as claimed in claim 2, further comprising a retainer having a basic board and at least a pair of surrounding portions extending vertically thereupon, the outer cover portion of the conductor shell having a pair of slots defined therein, and the retainer engaging the conductor shell by clamping its surrounding portions into respective slots of the outer cover portion so as to retain the coaxial cable.

* * * * *